US005510150A

United States Patent [19]

Koskinen

[11] Patent Number: 5,510,150

[45] Date of Patent: Apr. 23, 1996

[54] JET COATING METHOD

[75] Inventor: Jukka Koskinen, Helsinki, Finland

[73] Assignee: Valmet Corporation, Helsinki, Finland

[21] Appl. No.: 305,078

[22] Filed: Sep. 13, 1994

Related U.S. Application Data

[62] Division of Ser. No. 142,728, Oct. 25, 1993, abandoned.

[30] Foreign Application Priority Data

Oct. 26, 1992 [FI] Finland ..... 924841

[51] Int. Cl.[6] ..... B05D 1/26

[52] U.S. Cl. ..... 427/434.2; 427/356; 427/439; 118/410; 118/419

[58] Field of Search ..... 118/410, 419; 427/356, 434.2, 439

[56] References Cited

U.S. PATENT DOCUMENTS

| | | | |
|---|---|---|---|
| 4,452,833 | 6/1984 | Holt | 427/356 |
| 4,537,801 | 8/1985 | Takeda | 427/356 |
| 4,697,542 | 10/1987 | Kohler et al. | 118/63 |
| 4,791,879 | 12/1988 | Eklund et al. | 118/410 |
| 4,834,018 | 5/1989 | Sollinger et al. | 427/356 |
| 4,920,913 | 5/1990 | Knop et al. | 118/410 |
| 4,934,310 | 6/1990 | Wöhrle et al. | 427/356 |

FOREIGN PATENT DOCUMENTS

| | | | |
|---|---|---|---|
| 3446525 | 8/1985 | Germany | 118/410 |

*Primary Examiner*—Shrive Beck
*Assistant Examiner*—Katherine A. Bareford
*Attorney, Agent, or Firm*—Cohen, Pontani, Lieberman, Pavane

[57] ABSTRACT

A jet coating method for applying coating mix onto a moving web in a noncontacting manner in ambient pressure which includes the step of directing a jet of the coating mix counter to an approach direction of the web at a velocity sufficiently high to attain a splitting of the jet into a return flow and a coating mix application flow.

4 Claims, 4 Drawing Sheets

JET COATING METHOD

This is a division of the application Ser. No. 08/142,728, filed Oct. 25, 1993, now abandoned.

BACKGROUND OF THE INVENTION

1. Field of the Invention

The present invention relates to a jet coating method for applying a coating mix onto a moving web in a non-contacting manner at ambient pressure.

2. Description of the Prior Art

EP patent application 0,466,420 discloses a jet coating method in which a jet coating apparatus is employed for applying the coating mix on the web and the final coat weight is controlled by means of an actual doctor blade. The coating mix is applied on the web in ambient pressure without a pressurized coating chamber. The jet coating unit of the apparatus is tiltable about its tip, thus permitting when necessary an almost perpendicular application of the coating mix jet onto the web. Particularly at high web speeds (above 1000 m/min), problems are caused by entrained air carried over in the web and applied coating mix, resulting in inferior coat quality, mottling and possibly uncoated areas. Moreover, the air entrained in the web causes unevenness of the applied coat. Sufficient penetration of the mix into the web is also difficult to attain.

Further, known in the art from FI patent application 89 0249 (U.S. Pat. No. 5,104,697) is a brush coating apparatus in which the coating mix is applied onto the web via a channel of narrow slot orifice with the help of a predoctoring blade tilted to a narrow angle with respect to the web. Typically, the embodiment also incorporates a doctor blade arranged at the same backing roll. This embodiment has problems in some operating situations particularly when the tension distribution of the base web is uneven, whereby the two points (coating apparatus and doctor blade) contacting the web produce a deleteriously uneven distribution of cross-machine web tension between these two points. Such a situation causes runnability problems under certain conditions.

SUMMARY OF THE INVENTION

It is an object of the present invention to overcome the drawbacks of the above-described techniques and to achieve an entirely novel jet coating apparatus and method.

The invention is based on designing the apparatus such that it directs a coating mix jet from a jet coating apparatus, which is noncontactingly outdistanced from the web, in ambient pressure at least partially counter to the machine direction of the web. In other words, the directional vector of the coating mix jet which exits the slot orifice has a component opposite to the machine direction of the web.

More specifically, the jet coating apparatus according to the invention is characterized by a slot orifice defined by bounding surfaces of an upper lip and a lower lip. A directional vector located within the slot orifice along the bounding surface of the lower lip having a vector component that is opposite to the tangential velocity vector of the moving web.

Furthermore, the jet coating method according to the invention is characterized by directing a jet of coating mix counter to the approach direction of the web at a velocity sufficient to split the jet into a return flow and a coating mix application flow.

The invention provides significant benefits.

Owing to the noncontacting coating principle, uneven distribution of web tension in the cross-machine direction is avoided. Owing to the jet coating directed counter to the machine direction of the web travel, good penetration of the coating mix into the base web is attained. Jet coating directed counter to the machine direction of the web travel also prevents air ported by the web from entraining into the coating mix, thus reducing the occurrence of uncoated areas on the web. Additionally, the counterdirectional jet coating technique alleviates problems caused by air bubbles entrained in the coating mix.

In the following the invention is described in greater detail with the help of exemplifying embodiments illustrated in the annexed drawings.

DETAILED DESCRIPTION OF THE PREFERRED EMBODIMENTS

Figure 1:
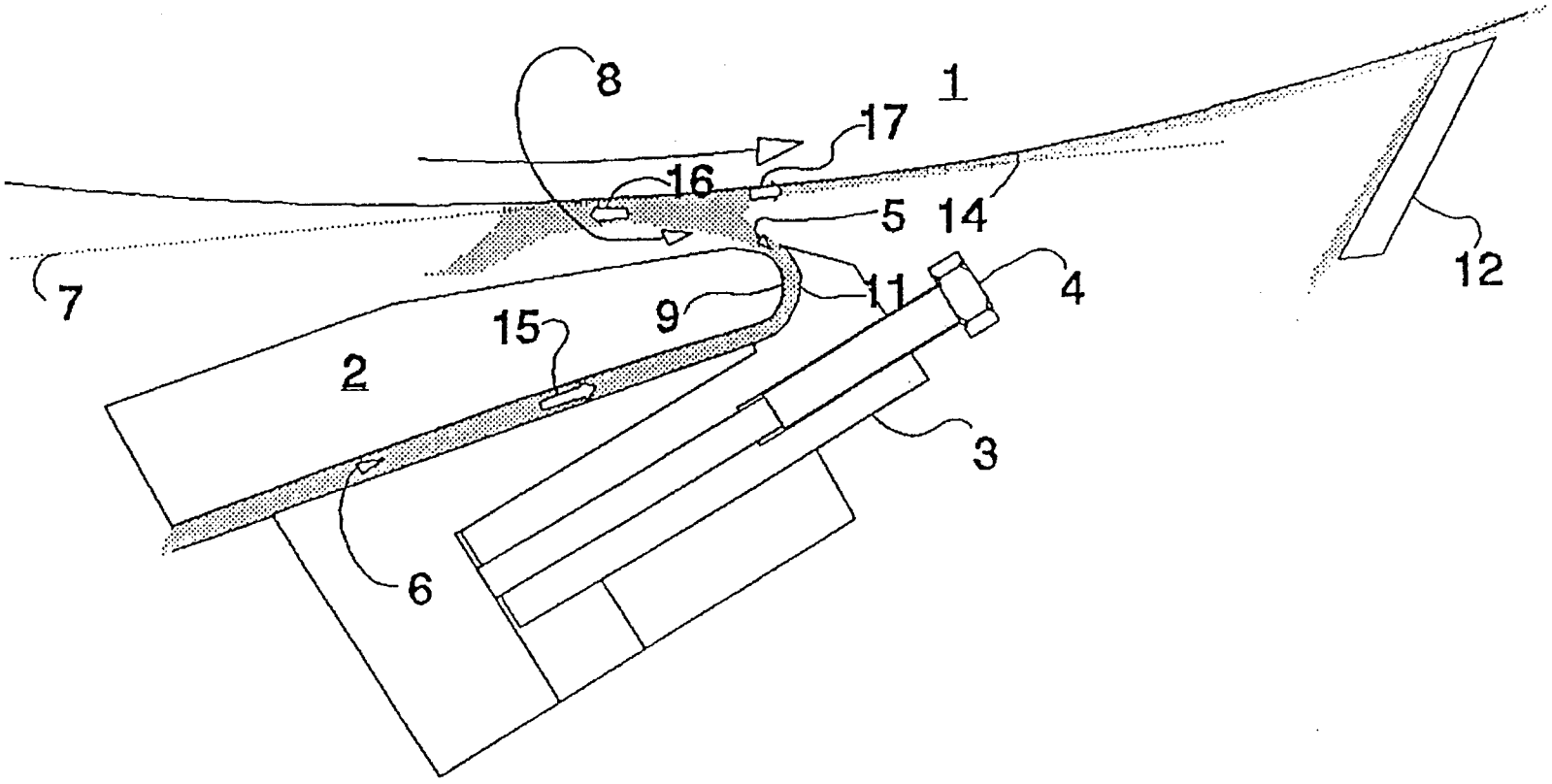
FIG. 1 shows a longitudinally sectional side view of a jet coating apparatus according to the invention.

With reference to FIG. 1, a tangent line drawn tangentially to the surface of a backing roll 1, at the slot orifice 5 of a jet-coating apparatus which is placed essentially under the backing roll 1, is denoted by a dashed line 7. The jet coating apparatus comprises an upper lip 2 and a lower lip 3. The slot orifice 5 of the coating apparatus is formed by a curved slot orifice bounding surface 9 of the upper lip and a conformantly curved slot orifice bounding surface 11 of the lower lip 3. The path of the coating mix starts as a narrow channel 6, which typically further tapers into the slot orifice 5. The width of the channel 6 is initially approx. 0.5–10 mm, typically in the range 1.5–4 mm. Obviously, the channel 6 must extend in the cross-machine direction at least over the cross-machine width of the web 14. The width of the slot orifice 5 is typically in the range 0.5–10 mm. The spacing at the gap 8 between the jet coating apparatus and the backing roll 1 (web 14) is typically 1–20 mm, advantageously approx. 3–8 mm. The width of the gap 5 is adjustable by a screw 4. This spacing adjustment affects the coating mix flow velocity. With a constant-volume feed, the coating mix exit velocity increases when the slot orifice 5 is adjusted smaller. Also the upper lip 2 can be arranged adjustable with respect to the coater frame, thus permitting also a cross-sectional adjustment of the channel 6 when necessary. The curved tip 9 of the upper lip 2 induces the known Coanda effect, whereby the coating mix jet tends to adhere to the bounding surface of the upper lip 2 in the gap 8. The radius of curvature of the tip 9 can vary in the range 1–50 mm; however, the radius of curvature is typically in the range 3–10 mm. Additionally, a conventional doctor blade 12 is provided at the roll 1 downstream of the jet coating apparatus.

Figure 2:
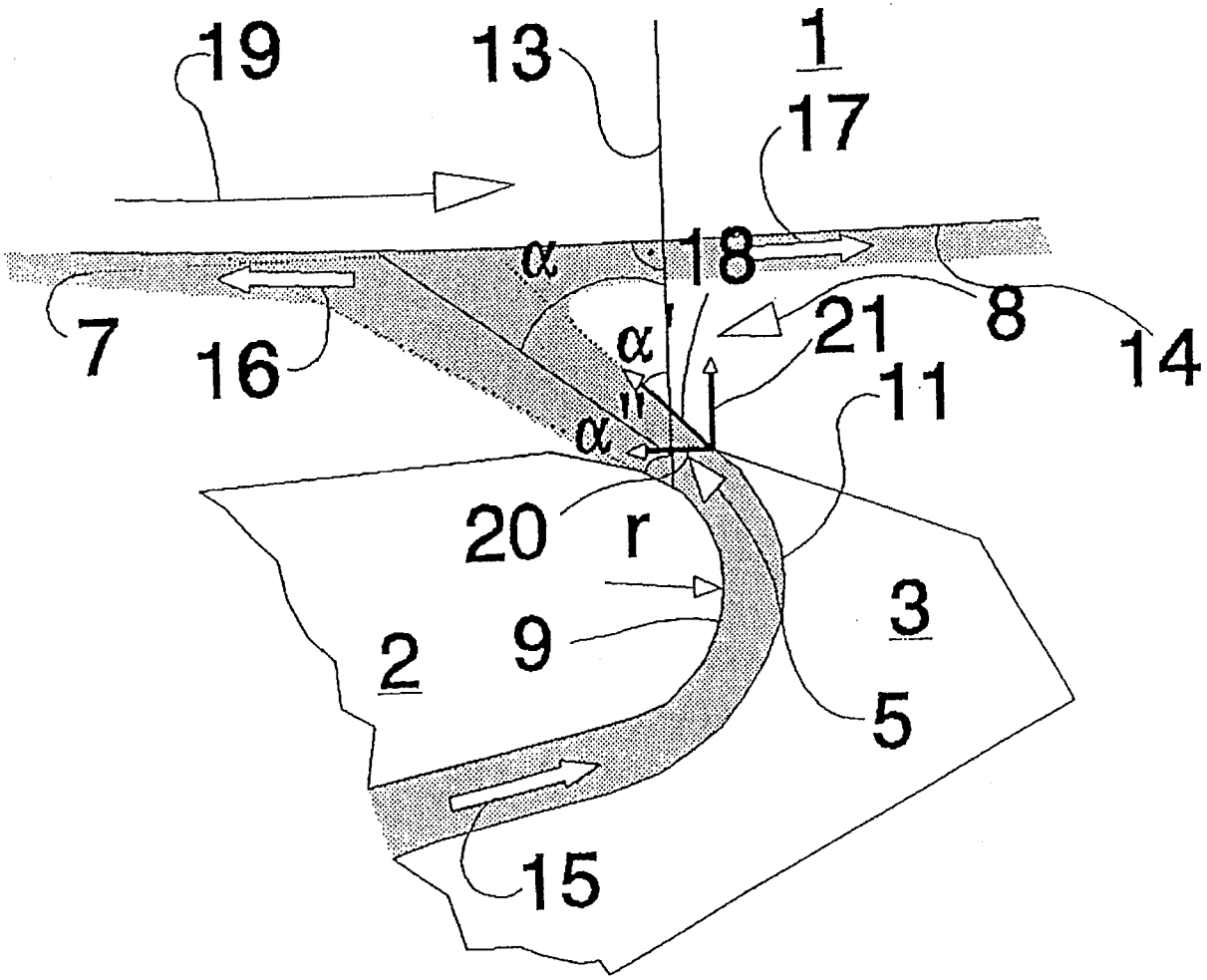
FIG. 2 shows a detail of the embodiment illustrated in FIG. 1.

With reference to FIG. 2, a normal 13 is drawn to the tangent 7 at the backing roll 1 (and the web 14) at the slot orifice 5. The coating mix jet exiting the slot orifice 5 can be characterized by two angles:

α': angle between the jet upper surface and the normal 13, or the trailing angle, and α": angle between the jet lower surface and the normal 13, or the back angle.

Then, the average angle, jet tilt angle α is obtained as the average of these angles, or (α'+α")/2. The angle α can be adjusted by means of a) the radius of curvature, r, whereby a smaller radius of curvature facilitates the use of a large value for the angles and α and α', b) the screw 4 (FIG. 1) which adjusts the width of the slot orifice 5, whereby a smaller width of the slit 5 increases the angle α, and c) adjustment of the length of the bounding surface 11 of the lower lip 3. The shorter the guiding bounding surface 11, the smaller will be the angle and the angle α'.

The design of the curved channel according to the diagram has the basic requirement that the slot orifice bounding surface 11 of the lower lip 3 in the region of the slot orifice 5 is curved toward the approach direction of the web 14, whereby a desired direction of the coating mix jet is attained. Further, the velocity of the coating mix jet must be sufficiently high to attain the splitting of the jet stream into two flows 16 and 17. A sufficient limit velocity is 1.5 m/s when the distance of the slot orifice 5 from the web is 3 mm, the slot orifice width is 2 mm and the web speed is 1000 m/min. The minimum limit velocity of the jet will be higher if the distance of the slot orifice 5 from the web surface is wider. Increasing the web speed also has an effect of increasing the minimum limit velocity of the coating mix jet. A desirable jet velocity is achieved by means of an efficient coating mix pump (not shown).

The basic principle of the invention is to design the slot orifice structure such that it has the trailing angle $\alpha'>0°$, whereby the coating mix jet is directed counter to the machine-direction of travel of the web 14. The angle α' can be varied in the range $0°<\alpha'\leqq 90°$, typically $0°<\alpha'\leqq 60°$.

With reference to FIG. 2, the total flow 15 of the coating mix jet is split after the slot orifice 5 into two branches, a return flow 16 and a coating mix flow 17. Owing to the tilted direction and velocity of the jet, the return flow 16 represents approx. 30–60% of the total flow 15. Typically, the proportion of the return flow is approx. 50%.

Besides the angle α', the invention can be characterized by the directional vector 18 along the slot orifice bounding surface 11 of the lower lip 3, whereby said vector can be divided into a vector component 21 orthogonal to the tangential velocity vector 19 of the web and a vector component 20 opposite to said tangential web velocity vector. A prerequisite for the correct aiming of the coating mix jet is the existence of said oppositely directed vector component 20. As the direction vector 18 determines the trailing angle of the coating mix jet, the vector 18 can also be defined through the angle α'. The vector 18 also subtends the angle α'with the normal 13.

Figure 3:
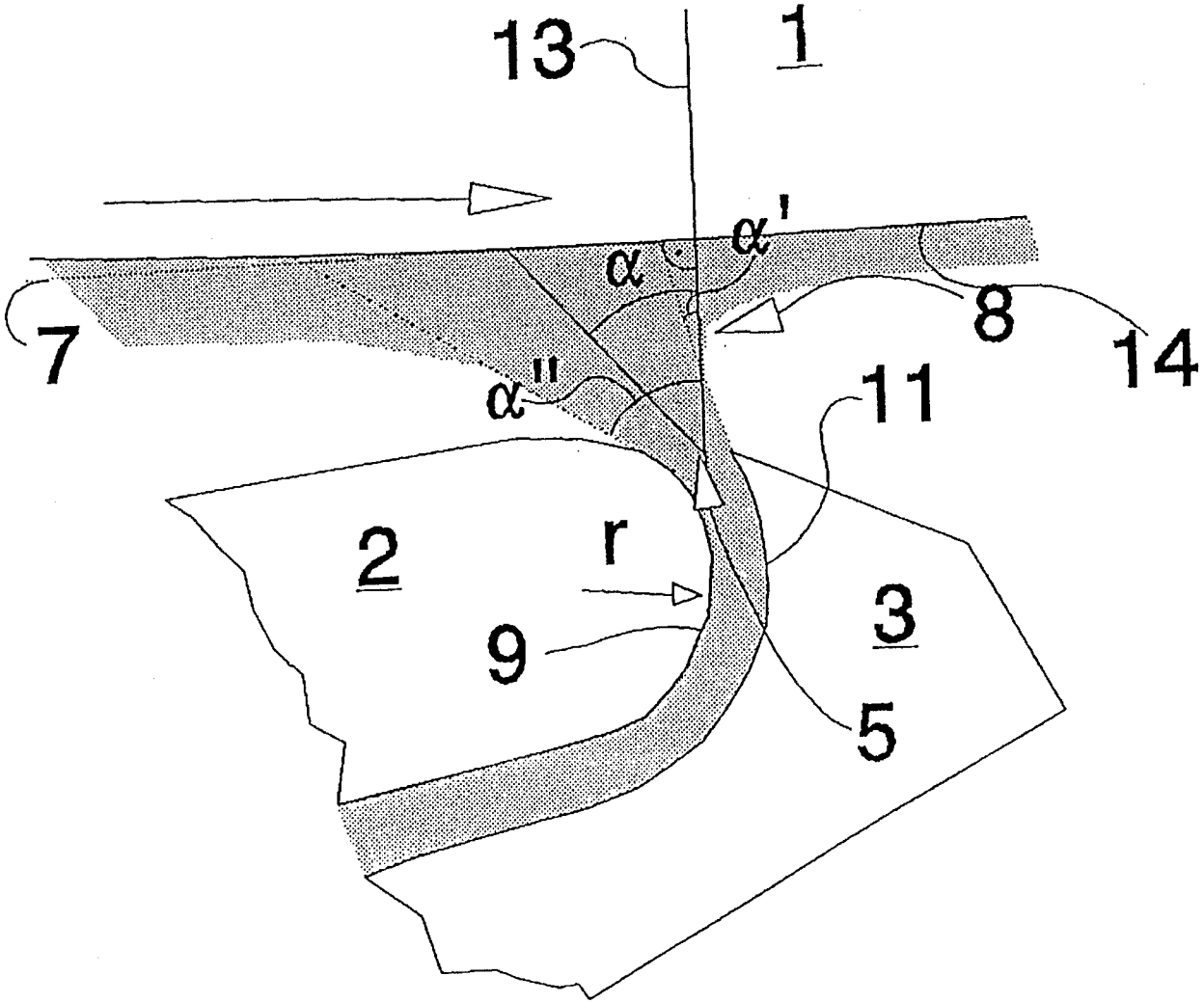
FIG. 3 shows an alternative embodiment to that illustrated in FIG. 2.

In comparison with that shown in FIG. 2, the embodiment according to FIG. 3 has the radius of curvature r slightly increased and the bounding surface 11 shortened, whereby the angles α and α' and will become smaller.

Figure 4:
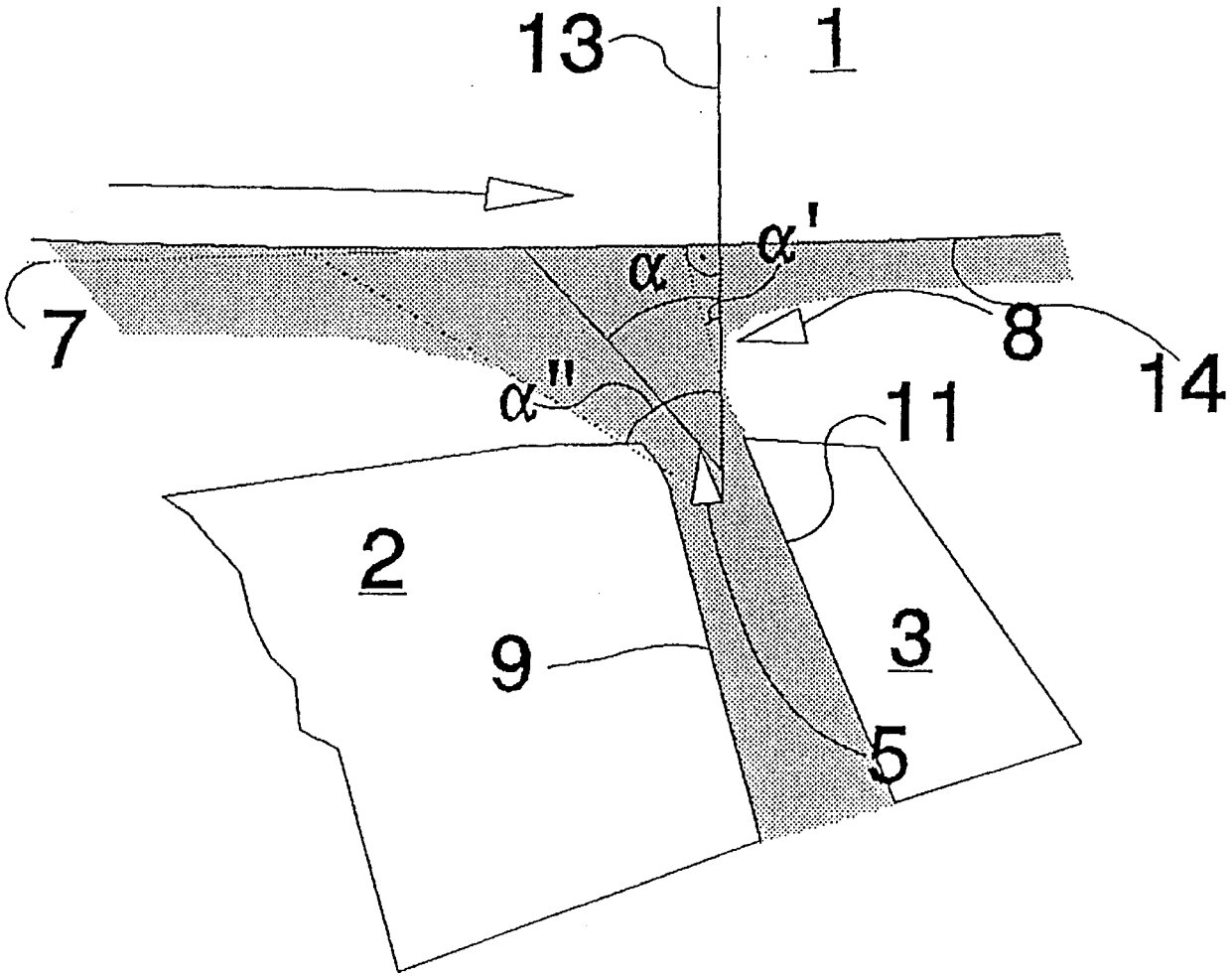
FIG. 4 shows a longitudinally sectional side view of another jet coating apparatus according to the invention.

The lower lips 3 illustrated in FIGS. 3 and 4 are easily replaceable with a flexible blade, thus making the apparatus conveniently convertible for use with different web materials and coating mixes.

FIG. 4 illustrates an alternative embodiment according to the invention having the slot orifice bounding surfaces 9 and 11 designed essentially uncurved.

I claim:

1. A jet coating method for applying coating mix onto a moving web (14) in a noncontacting manner at ambient pressure without using a pressurized chamber in a region where the coating mix contacts the web, comprising the step of directing a jet of the coating mix counter to an approach direction of the web (14) at a velocity sufficiently high to attain a splitting of the jet into a return flow (16) and a coating mix application flow (17), said jet being unrestricted in the region where the coating mix contacts the web.

2. A method as defined in claim 1, including arranging a slot orifice (5) defined by a lower lip and an upper lip at a distance from the web (14) so as to define a free unconstrained region between the web and the slot orifice (5), and directing the coating mix jet through the slot orifice (5) so that a trailing angle α' defined between the coating mix application flow and a normal (13) of a tangent line (7) drawn tangentially to a backing roll and the web at the slot orifice (5) is greater than 0°.

3. A method as defined in claim 2, wherein the trailing angle α' is adjusted by moving the lower lip (3).

4. A method as defined in claim 3, including adjusting the trailing angle α' by moving the lower lip (3) by means of an adjustment screw (4).

* * * * *